US010418716B2

(12) United States Patent
Zimmerman et al.

(10) Patent No.: US 10,418,716 B2
(45) Date of Patent: Sep. 17, 2019

(54) LENSED ANTENNAS FOR USE IN CELLULAR AND OTHER COMMUNICATIONS SYSTEMS

(71) Applicant: CommScope Technologies LLC, Hickory, NC (US)

(72) Inventors: Martin Zimmerman, Chicago, IL (US); Igor Timofeev, Dallas, TX (US); Kevin Eldon Linehan, Rowlett, TX (US)

(73) Assignee: CommScope Technologies LLC, Hickory, NC (US)

( * ) Notice: Subject to any disclaimer, the term of this patent is extended or adjusted under 35 U.S.C. 154(b) by 445 days.

(21) Appl. No.: 15/246,808

(22) Filed: Aug. 25, 2016

(65) Prior Publication Data

US 2017/0062944 A1 Mar. 2, 2017

Related U.S. Application Data

(60) Provisional application No. 62/210,813, filed on Aug. 27, 2015, provisional application No. 62/315,811, filed on Mar. 31, 2016.

(51) Int. Cl.

| | |
|---|---|
| ***H01Q 15/02*** | (2006.01) |
| ***H01Q 1/24*** | (2006.01) |
| ***H01Q 19/06*** | (2006.01) |
| ***H01Q 3/14*** | (2006.01) |
| ***H01Q 15/08*** | (2006.01) |
| ***H01Q 15/10*** | (2006.01) |

(Continued)

(52) U.S. Cl.

CPC ..... *H01Q 15/02* (2013.01); *H01Q 1/246* (2013.01); *H01Q 3/14* (2013.01); *H01Q 15/08* (2013.01); *H01Q 15/10* (2013.01); *H01Q 19/062* (2013.01); *H01Q 21/061* (2013.01); *H01Q 21/08* (2013.01); *H01Q 19/108* (2013.01); *H01Q 21/062* (2013.01); *H01Q 21/26* (2013.01); *H01Q 21/28* (2013.01)

(58) Field of Classification Search

CPC ..... H01Q 15/02; H01Q 1/24; H01Q 19/06; H01Q 25/00

USPC ..... 343/837

See application file for complete search history.

(56) References Cited

U.S. PATENT DOCUMENTS

| | | | |
|---|---|---|---|
| 3,243,483 | A | 3/1966 | Marshall |
| 4,288,337 | A | 9/1981 | Ota et al. |

(Continued)

FOREIGN PATENT DOCUMENTS

| | | |
|---|---|---|
| EP | 0309982 A2 | 4/1989 |
| GB | 665747 | 1/1952 |

(Continued)

OTHER PUBLICATIONS

Multi-Beam Base Station Antennas, www.matsing.com/products/multi-beam-base-station-antennas, 7 pages, Admitted Prior Art.

(Continued)

*Primary Examiner* — Andrea Lindgren Baltzell
(74) *Attorney, Agent, or Firm* — Myers Bigel, P.A.

(57) ABSTRACT

Phased array antennas include a plurality of radiating elements and a plurality of RF lenses that are generally aligned along a first vertical axis. Each radiating element is associated with a respective one of the RF lenses, and each radiating element is tilted with respect to the first vertical axis.

21 Claims, 7 Drawing Sheets

(51) Int. Cl.

| | |
|---|---|
| ***H01Q 21/06*** | (2006.01) |
| ***H01Q 21/08*** | (2006.01) |
| *H01Q 19/10* | (2006.01) |
| *H01Q 21/26* | (2006.01) |
| *H01Q 21/28* | (2006.01) |

(56) References Cited

U.S. PATENT DOCUMENTS

| | | | | |
|---|---|---|---|---|
| 4,613,784 | A | 9/1986 | Haun et al. | |
| 5,821,908 | A * | 10/1998 | Sreenivas | H01Q 15/06 343/911 R |
| 6,781,487 | B2 | 8/2004 | Hattori et al. | |
| 7,068,898 | B2 | 6/2006 | Buretea et al. | |
| 7,113,146 | B2 | 9/2006 | Pearlman et al. | |
| 7,268,637 | B2 | 9/2007 | Aisenbrey | |
| 7,317,420 | B2 | 1/2008 | Aisenbrey | |
| 7,365,395 | B2 | 4/2008 | Stumbo et al. | |
| 7,405,710 | B2 | 7/2008 | Bisiules et al. | |
| 7,592,957 | B2 | 9/2009 | Achour et al. | |
| 7,605,768 | B2 * | 10/2009 | Ebling | H01Q 1/3233 343/700 MS |
| 8,089,152 | B2 | 1/2012 | Miller | |
| 8,271,241 | B2 | 9/2012 | Akyurtlu et al. | |
| 8,518,537 | B2 | 8/2013 | Matitsine | |
| 8,558,311 | B2 | 10/2013 | Dubrow et al. | |
| 8,854,257 | B2 | 10/2014 | Hamner et al. | |
| 8,917,215 | B2 | 12/2014 | Pohl | |
| 2001/0029119 | A1 | 10/2001 | Chung | |
| 2003/0062639 | A1 | 4/2003 | Myhre | |
| 2004/0104847 | A1 | 6/2004 | Killen et al. | |
| 2006/0192720 | A1 * | 8/2006 | Shtrom | H01Q 1/38 343/795 |
| 2006/0244669 | A1 | 11/2006 | Mansour et al. | |
| 2010/0001900 | A1 | 1/2010 | Imai et al. | |
| 2011/0205119 | A1 | 8/2011 | Timofeev et al. | |
| 2015/0070230 | A1 | 3/2015 | Bradley et al. | |
| 2015/0091767 | A1 | 4/2015 | Matitsine et al. | |
| 2015/0325348 | A1 | 11/2015 | Matitsine | |
| 2017/0040683 | A1 * | 2/2017 | Matitsine | H01Q 3/14 |

FOREIGN PATENT DOCUMENTS

| | | | |
|---|---|---|---|
| GB | 1125828 | A | 9/1968 |
| GB | 2442796 | A | 4/2008 |
| JP | 53-026996 | | 3/1978 |
| JP | 2001-316514 | A | 11/2001 |
| WO | WO 2002/102584 | A1 | 12/2002 |
| WO | WO 2005/002841 | A1 | 1/2005 |

OTHER PUBLICATIONS

Notification of Transmittal of the International Search Report and the Written Opinion of the International Searching Authority for corresponding PCT/US16/48908, dated Dec. 2, 2016 (14 pages).

Extended European Search Report, corresponding to European Patent Application No. 16840189.1, dated Mar. 26, 2019, 12 pages.

* cited by examiner

LENSED ANTENNAS FOR USE IN CELLULAR AND OTHER COMMUNICATIONS SYSTEMS

CROSS-REFERENCE TO RELATED APPLICATIONS

The present application claims priority under 35 U.S.C. § 119 to U.S. Provisional Patent Application Ser. No. 62/210,813, filed Aug. 27, 2015, and to U.S. Provisional Patent Application Ser. No. 62/315,811, filed Mar. 31, 2016, the entire content of each of which is incorporated herein by reference.

FIELD

The present invention generally relates to radio communications and, more particularly, to lensed antennas that are suitable for use in cellular and various other types of communications systems.

BACKGROUND

Cellular communications systems are well known in the art. In a typical cellular communications system, a geographic area is divided into a series of regions that are referred to as "cells," and each cell is served by a base station. The base station may include baseband equipment, radios and antennas that are configured to provide two-way radio frequency ("RF") communications with mobile subscribers that are geographically positioned within a "coverage area" served by the base station. In many cases, the coverage area may be divided into a plurality of "sectors," and separate antennas are provided for each of the sectors. Typically, these antennas are mounted on a tower or other raised structure, with the radiation beam(s) that are generated by each antenna directed outwardly to serve the respective sector.

A common wireless communications network plan involves a base station serving a coverage area using three base station antennas. This is often referred to as a three-sector configuration. In a three-sector configuration, each base station antenna serves a 120° sector of the coverage area. Typically, a 65° azimuth Half Power Beamwidth (HPBW) antenna provides coverage for a 120° sector. Three of these antennas provide 360° coverage. Typically, each antenna comprises a linear phased array antenna that includes a plurality of radiating elements that are arranged as a single column of radiating elements. Other sectorization schemes may also be employed. For example, six, nine, and twelve sector configurations are also used. Six sector sites may involve six directional base station antennas, each having a 33° azimuth HPBW antenna serving a 60° sector. In other proposed solutions, a single, multi-column phased array antenna may be driven by a feed network to produce two or more beams from a single phased array antenna. Each beam may provide coverage to a sector. For example, if multi-column phased array antennas are used that each generate two beams, then only three antennas may be required for a six sector configuration. Antennas that generate multiple beams are disclosed, for example, in U.S. Patent Publication No. 2011/0205119 and U.S. Patent Publication No. 2015/0091767, the entire content of each of which is incorporated herein by reference.

Increasing the number of sectors increases system capacity because each antenna can service a smaller area and therefore provide higher antenna gain throughout the sector and/or allow for frequency reuse. However, dividing a coverage area into smaller sectors has drawbacks because antennas covering narrow sectors generally have more radiating elements that are spaced wider apart than are the radiating elements of antennas covering wider sectors. For example, a typical 33° azimuth HPBW antenna is generally twice as wide as a typical 65° azimuth HPBW antenna. Thus, cost, space and tower loading requirements may increase as a cell is divided into a greater number of sectors.

SUMMARY

Pursuant to embodiments of the present invention, phased array antennas are provided that include a plurality of radiating elements and a plurality of RF lenses that are generally aligned along a first vertical axis. Each radiating element is associated with a respective one of the RF lenses, and each radiating element is tilted with respect to the first vertical axis.

In some embodiments, the radiating elements may be aligned along a second vertical axis that is parallel to the first vertical axis.

In some embodiments, a center of each radiating element may be positioned vertically along the second vertical axis at a point that is higher than a center of its associated RF lens along the first vertical axis when the phased array antenna is mounted for use.

In some embodiments, each radiating element may be positioned so that a center of a radiation pattern that is emitted by the radiating element when excited is directed at a center point of its associated RF lens.

In some embodiments, each radiating element may be tilted between 2 and 10 degrees with respect to the first vertical axis. Each radiating element may be tilted the same amount with respect to the first vertical axis.

In some embodiments, each RF lens may comprise a spherical RF lens. In other embodiments, each RF lens may be an elliptical RF lens.

In some embodiments, each radiating element may be positioned at the same distance from its associated RF lens.

In some embodiments, each radiating element may be mounted on a respective ground plane, and each ground plane may be vertically aligned along a third vertical axis. Each ground plane may define a respective plane that is tilted at least 2 degrees with respect to the third vertical axis.

In some embodiments, the RF lens may include a dielectric material that comprises a foamed base dielectric material having particles of a high dielectric constant material embedded therein, the high dielectric constant material having a dielectric constant that is at least three times a dielectric constant of the foamed base dielectric material. The high dielectric constant material may have a dielectric constant of at least 10 in some embodiments. The high dielectric constant material may comprise, for example, a metal oxide or a ceramic material. The foamed dielectric material may have a foaming percentage of at least 50%. In some embodiments, the RF lens may include a dielectric material that comprises a foamed base dielectric material having conductive fibers embedded therein.

In other embodiments, the RF lens may include a dielectric material that comprises expandable microspheres mixed with pieces of conductive sheet material that have an insulating material on each major surface. This dielectric material may further include a binder such as an inert oil. The small pieces of conductive sheet material having an insulating material on each major surface may comprise, for example, flitter or glitter. In some embodiments, an average surface area of the small pieces of conductive sheet material having an insulating material on each major surface may exceed an average surface area of the expandable microspheres after expansion. In still other embodiments, the RF lens may include a dielectric material that comprises small pieces of a foamed dielectric material that have at least one sheet of conductive material embedded therein.

Pursuant to further embodiments of the present invention, multi-beam antennas are provided that include a plurality of radiating elements and an RF lens that is positioned in front of the radiating elements. The radiating elements are positioned at least part of the way around a side of the RF lens, and the radiating elements are arranged in a plurality of rows and columns, where each row extends in a respective arc in a respective one of a plurality of horizontal planes and each column extends in a respective arc in a respective one of a plurality of vertical planes.

In some embodiments, the radiating elements may be active antenna elements.

In some embodiments, the RF lens may be a spherical RF lens, and the radiating elements may be orbitally arranged part of the way around the side of the spherical RF lens.

In some embodiments, the horizontal planes may be substantially parallel planes. The vertical planes may also be a plurality of substantially parallel planes in some embodiments. In other embodiments, the vertical planes may intersect each other.

In some embodiments, the antenna may further include an RF switch network that is configurable to connect a radio to a selected one or more of the radiating elements.

In some embodiments, each radiating element may be positioned so that a center of a radiation pattern that is emitted by the radiating element when excited is substantially directed at a center point of the RF lens.

In some embodiments, each radiating element may be positioned at the same distance from the RF lens.

In some embodiments, each radiating element may be mounted on a respective ground plane, and each ground plane may be orbitally arranged with respect to the spherical RF lens.

In some embodiments, the RF lens may include a dielectric material that comprises a foamed base dielectric material having particles of a high dielectric constant material embedded therein, the high dielectric constant material having a dielectric constant that is at least three times a dielectric constant of the foamed base dielectric material. The high dielectric constant material may be a metal oxide or a ceramic material. In other embodiments, dielectric material may be a foamed base dielectric material having one or more conductive sheets or conductive fibers embedded therein. In still other embodiments, the RF lens may include a dielectric material that comprises expandable microspheres mixed with pieces of conductive sheet material that have an insulating material on each major surface. This dielectric material may further include a binder such as an inert oil. The small pieces of conductive sheet material having an insulating material on each major surface may comprise, for example, flitter or glitter. In some embodiments, an average surface area of the small pieces of conductive sheet material having an insulating material on each major surface may exceed an average surface area of the expandable microspheres after expansion.

Pursuant to further embodiments of the present invention, multi-beam antennas are provided that include a plurality of radiating elements; a spherical RF lens that is positioned in front of the radiating elements; and a switching network that is configured to connect a radio to a respective subset of the radiating elements.

In some embodiments, each radiating element is positioned so that a center of a radiation pattern that is emitted by the radiating element when excited is substantially directed at a center point of the spherical RF lens.

In some embodiments, the subset of radiating elements may comprise a single one of the radiating elements. In other embodiments, the subset of the radiating elements may comprise a plurality of radiating elements that are connected to the switching network via a corporate feed network.

In some embodiments, the radiating elements may be orbitally arranged part of the way around the side of the spherical RF lens.

In some embodiments, each radiating element may be positioned at the same distance from the spherical RF lens.

In some embodiments, each radiating element may be mounted on a respective ground plane, and each ground plane is orbitally arranged with respect to the spherical RF lens.

In some embodiments, the spherical RF lens may include a dielectric material that comprises a foamed base dielectric material having particles of a high dielectric constant material embedded therein, the high dielectric constant material having a dielectric constant that is at least three times a dielectric constant of the foamed base dielectric material.

In some embodiments, the spherical RF lens may include a dielectric material that comprises a foamed base dielectric material having one or more conductive sheets or conductive fibers embedded therein.

In some embodiments, the radiating elements may be arranged to define a first plurality of arcs that extend in horizontal planes and at least one additional arc that extends in vertical plane.

It is noted that aspects described with respect to one embodiment may be incorporated in different embodiments although not specifically described relative thereto. That is, all embodiments and/or features of any embodiments can be combined in any way and/or combination. Moreover, other apparatus, methods and/or systems according to embodiments of the present invention will be or become apparent to one with skill in the art upon review of the following drawings and detailed description. It is intended that all such additional apparatus, systems and methods be included within this description and be protected by the accompanying claims. It is further intended that all embodiments disclosed herein can be implemented separately or combined in any way and/or combination.

DETAILED DESCRIPTION

Figure 1:
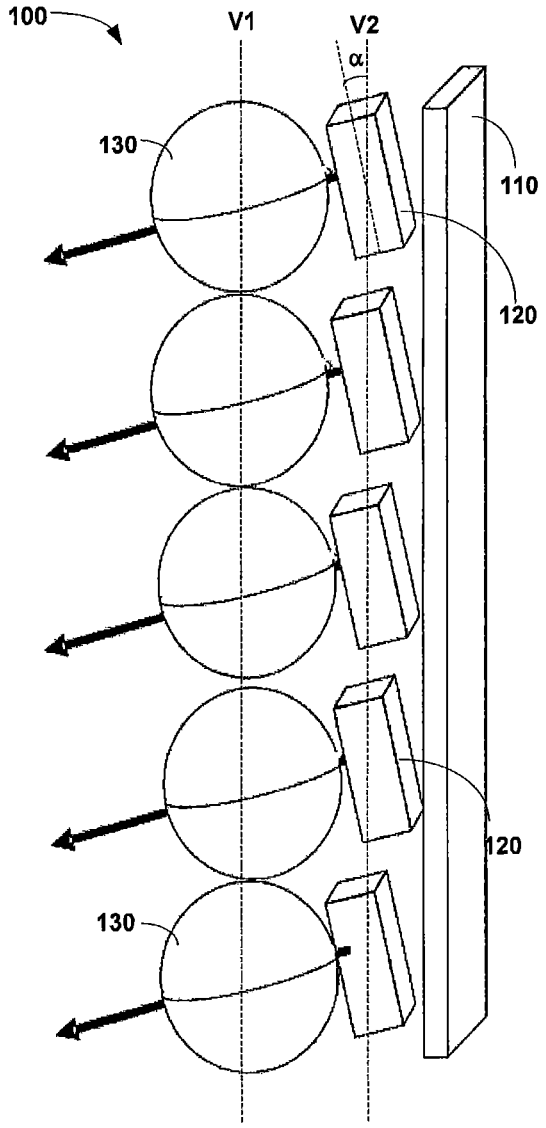
FIG. 1 is a schematic side view of a single-column phased array antenna that includes a spherical RF lens for each radiating element.

RF lenses may be used to narrow the azimuth beamwidth and/or elevation beamwidth of an antenna beam. For example, it is known that a spherical RF lens may be used to focus RF energy and narrow the beamwidth in the azimuth direction and the beamwidth in the elevation direction by approximately equal amounts. A single spherical lens, however, may not be well suited for many base station antennas as base station antennas often have substantially different requirements in terms of azimuth and elevation beamwidths (e.g., an azimuth beamwidth of 30-90 degrees and an elevation beamwidth of 5-15 degrees). Additionally, a spherical RF lens generates a symmetric pattern in both the azimuth and elevation planes. In many cases, base station antennas require an asymmetric pattern in the elevation plane with upper sidelobes (i.e., sidelobes pointed above the horizon) suppressed by an extra 5-15 dB relative to the lower sidelobes in the elevation plane.

Typically, a base station antenna is implemented as a phase-controlled linear array of radiating elements, with the radiating elements arranged in a single vertical column. Herein, "vertical" refers to a direction that is perpendicular relative to the plane defined by the horizon. Cylindrical RF lenses have been combined with such vertical linear arrays. An example of such an antenna is disclosed in U.S. Patent Publication No. 2015/0070230, the entire content of which is incorporated by reference. In base station antennas that include a cylindrical RF lens, the longitudinal axis of the lens may be oriented to be approximately parallel to the longitudinal axis of the linear array (i.e., both the lens and the linear array extend vertically with respect to the plane defined by the horizon). The characteristics of the linear array define the elevation beamwidth of the resulting beam pattern (i.e., the cylindrical lens does not generally modify the elevation beamwidth). Thus, the number of radiating elements in the linear array and the spacing between these elements, along with the design of the radiating elements and the frequency of operation, may be primary factors affecting the elevation beamwidth of the antenna. The cylindrical RF lens, however, acts to narrow the beamwidth of the azimuth pattern. In one example provided in the above-referenced U.S. Patent Publication No. 2015/0070230, a cylindrical RF lens is used to narrow the HPBW of a vertical linear array from about 65 degrees to about 33 degrees. Thus, an advantage of a linear array with a cylindrical lens is that it may achieve the performance of a multi-column phased array antenna with only a single column of radiating elements.

While generally beneficial, cylindrical RF lenses may exhibit certain disadvantages. For example, in some cases, cylindrical lenses may generate cross-polarization distortion. As known to those of skill in the art, cross-polarization distortion refers to the amount of energy emitted by a cross-polarized antenna that is transmitted at the orthogonal polarization. Cylindrical RF lenses also have a relatively high volume (e.g., volume=$\pi*r^2*L$), where "r" is the radius of the cylindrical lens and "L" is the length of the cylindrical lens. This large volume may increase the size, weight and cost of the antenna, particularly as the materials used to form the lens may be expensive. Additionally, as discussed above, cylindrical lenses do not narrow the elevation beamwidth, and hence the length of the linear array may be the primary factor used to reduce the elevation beamwidth. As typically the radiating elements in a linear array cannot be spaced apart by more than about 0.6-0.9 wavelengths of the signals that are transmitted and received therethrough without creating significant grating lobes, the increased length requirement for reducing elevation beamwidth results in a corresponding increase in the number of radiating elements included in the linear array. The use of a cylindrical RF lens does not address this issue.

Typically, corporate feed networks are used with the above-described phased array base station antennas. In order to reduce costs, these corporate feed networks often have a 1:4 or 1:5 geometry (meaning a single input and 4 or 5 outputs for RF signals travelling in the transmit direction). As the linear arrays typically have 8-15 radiating elements, the radiating elements are grouped into sub-arrays of radiating elements, where each sub-array is fed by a single output of the corporate feed network (and hence each radiating element that is included in a particular sub-array receives the same signal having a like phase and amplitude). For example, a 1:5 corporate feed network may be coupled to five sub-arrays, where each sub-array comprises one to three radiating elements. Increasing the number of radiating elements and/or sub-array assemblies add to the cost and complexity of the antenna. Additionally, if element spacing is increased to approach one wavelength in order to widen the aperture and narrow the elevation beamwidth while using a smaller number of radiating elements, grating lobes begin to appear as the radiation beam is electronically steered off mechanical boresight, as would be the case when remote electronic tilt is used to electronically downtilt the elevation pattern of the antenna.

Pursuant to embodiments of the present invention, single-column and multi-column phased array antennas are provided that include a plurality of spherical RF lenses. In some embodiments, the antennas may comprise single-column phased array antennas that include a spherical RF lens for each radiating element of the array. The use of individual spherical RF lenses as opposed to a single cylindrical RF lens that is associated with all of the radiating elements may reduce the weight and cost of the antenna. Moreover, the spherical RF lenses may narrow both the elevation and azimuth cuts of the radiating element patterns. Accordingly, it may be possible to obtain the same elevation beamwidth as with a conventional antenna while using a smaller number of radiating elements in the column(s) (which radiating elements are spaced farther apart than the radiating elements in the conventional antenna). Additionally, in some embodiments, the radiating elements may be downtilted with respect to the horizon and arranged orbitally with respect to their associated spherical RF lenses in order to exhibit improved performance when the antenna is electronically down-tilted.

In further embodiments of the present invention, some or all of the spherical RF lenses in the embodiments discussed above may be replaced with elliptical RF lenses.

In still further embodiments of the present invention, antennas may be provided in the form of multi-column phased arrays of radiating elements, where each radiating element in the array includes an associated spherical (or elliptical) RF lens. By providing multiple columns of radiating elements and associated RF lenses, the beamwidth of the antenna may be further reduced in the azimuth direction.

According to yet additional embodiments of the present invention, phased array antennas are provided that include a set of spherical or elliptical RF lenses that are aligned along a first vertical axis and at least first and second groups of radiating elements that are aligned along respective second and third vertical axes. A respective radiating element from the first group a respective radiating element from the second group may be associated with each RF lens. Each of the radiating elements may generate an independent antenna beam and may be fed by a separate radio. The RF lens may narrow the beams in both the azimuth and elevation directions and may hence allow reduction of the number of radiating elements.

According to still other embodiments of the present invention, multi-beam antennas are provided that include an RF lens and a plurality of radiating elements that are arranged orbitally about at least a part of a side of the RF lens. The RF lens may comprise a spherical RF lens, and the radiating elements may be arranged in arcs along two different directions. In some embodiments, each radiating element may be an active radiating element, and these active radiating elements may be configured to form pencil beams that provide coverage to users throughout a coverage area of the antenna. In other embodiments, the radiating elements may be fed by a switched corporate feed network that selectively supplies signals from a radio to groups of one or more of the radiating elements during the time slots of a frequency and time division multiplexing communication scheme. The switched corporate feed network may be switched at high speeds so as to direct a signal to be transmitted during any particular time slot to the radiating elements that provide coverage to portions of the coverage area that include users who transmit/receive signals during that particular time slot. During the next time slot, the switch network may be reconfigured to selectively supply another signal to a different subset of the radiating elements that provide coverage to portions of the coverage area that include users who transmit/receive signals during this subsequent time slot.

Embodiments of the present invention will now be discussed in further detail with reference to the figures, in which example embodiments of the invention are shown.

FIG. 1 is a schematic side view of a single-column phased array antenna 100 that includes a spherical RF lens for each radiating element. Referring to FIG. 1, the antenna 100 includes a plurality of radiating elements 120 that are mounted on a mounting structure 110. The mounting structure 110 may comprise a unitary structure or may comprise a plurality of structures that are attached together. The mounting structure 110 may comprise, for example, a planar reflector that serves as a ground plane for the radiating elements 120. The antenna 100 further includes a plurality of spherical RF lenses 130. The spherical RF lenses 130 may be mounted in a first column. The first column may extend in a direction that is substantially perpendicular to a plane defined by the horizon so that the RF lenses 130 are generally aligned along a first vertical axis V1. The radiating elements 120 may be mounted in a second column. The second column may likewise extend in the vertical direction so that the radiating elements 120 are generally aligned along a second vertical axis V2. The first vertical axis V1 extends in parallel to the second vertical axis V2. When the antenna 100 is mounted for use, the azimuth plane is perpendicular to the longitudinal axis of the antenna 100 (and to vertical axes V1 and V2), and the elevation plane is parallel to the longitudinal axis of the antenna 100.

Figure 6A:
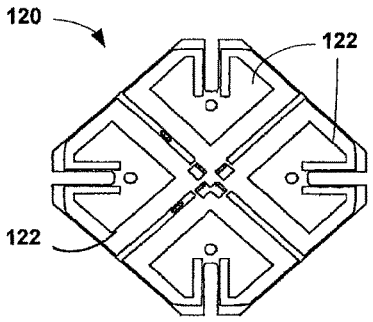
FIG. 6A is a plan view of an example dual polarized radiating element that may be used in the multi-beam antennas of FIGS. 1-5.
Figure 6B:
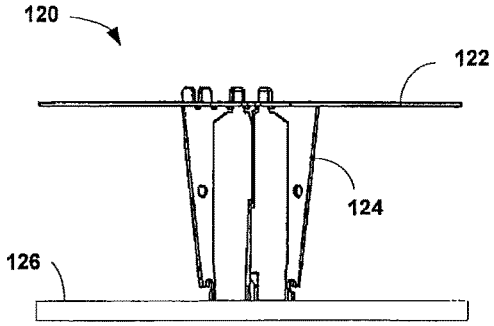
FIG. 6B is a side view of the example dual polarized radiating element of FIG. 6A.

The radiating elements 120 are illustrated schematically in FIG. 1 as rectangular cubes to simplify the drawing. Each radiating element 120 may comprise, for example, a dipole, a patch or any other appropriate radiating element. FIGS. 6A-6B illustrate an example implementation of a radiating element 120. In particular, FIG. 6A is a plan view of the example radiating element 120, and FIG. 6B is a side view thereof. In the example embodiment shown, the radiating element 120 comprises a pair of cross-polarized radiating elements, where one radiating element of the pair radiates RF energy with a +45° polarization and the other radiating element of the pair radiates RF energy with a ~45° polarization.

As shown in FIG. 6A, the example radiating element 120 includes four dipoles 122 that are arranged in a square or "box" arrangement. The four dipoles 122 are supported by feed stalks 124, as illustrated in FIG. 6B. Each radiating element 120 includes two linear orthogonal polarizations (slant +45°/−45°). Each radiating element 120 may also include a ground plane 126 that is positioned behind the dipoles 122 so that, for example, the dipoles 122 are adjacent one end of the feed stalks 124 and the ground plane 126 is adjacent the other end of the feed stalks 124. As noted above, the mounting structure 110 may comprise the ground plane.

In other embodiments, the single-column phased array antenna 100 may have box radiating elements that are configured to radiate in different frequency bands, interleaved with each other as shown in U.S. Pat. No. 7,405,710 ("the '710 patent"), the entire content of which is incorporated herein by reference. As shown in the '710 patent, the dual-frequency box radiating elements may comprise a first array of box-type dipole radiating elements that are coaxially disposed within a second box-type dipole assembly. The use of such radiating elements may allow a lensed antenna to operate in two frequency bands (for example, 0.79-0.96 GHz and 1.7-2.7 GHz). For the antenna to provide similar beamwidths in both frequency bands, the high band radiating elements may have directors. In this case, a low band radiating element may have, for example, a HPBW in the azimuth direction of 65-50°, and a high band radiating element may have a HPBW in the azimuth direction of 45-35°, and when these radiating elements are used in conjunction with one or more lenses, the antenna will have stable HPBW in the azimuth direction of about 23° across both frequency bands. Examples of suitable dual-band radiating elements and directors are disclosed in the above-referenced U.S. Patent Publication No. 2015/0091767.

Referring again to FIG. 1, the single-column phased array antenna 100 further includes a plurality of spherical RF lenses 130. Each radiating element 120 is associated with a respective one of the spherical RF lens 130. The combination of a radiating element 120 and its associated spherical RF lens 130 may provide a radiation pattern that is narrowed in both the azimuth and elevation directions. For an antenna operating at about 2 GHz, a 220 mm spherical RF lens 130 may be used to generate an azimuth half power beamwidth of about 35 degrees. The spherical RF lens 130 may include (e.g., be filled with or consist of) a material having a dielectric constant of about 1 to about 3 in some embodiments. In other embodiments, the spherical RF lens 130 may include a material having a dielectric constant of about 1.8 to about 2.2. The dielectric material of the spherical RF lens 130 focuses the RF energy that radiates from, and is received by, the associated radiating element 120.

A spherical shell filled with particles of the artificial dielectric material described in U.S. Pat. No. 8,518,537 (incorporated herein by reference) may be used to form the spherical RF lenses 130 in some embodiments. In such embodiments, each particle may comprise a small block of the dielectric material that includes at least one needle-like (or other shaped) conductive fiber embedded therein. The small blocks may be formed into a larger structure using an adhesive that glues the blocks together. The blocks may have a random orientation within the larger structure. The base dielectric material used to form the blocks may be a lightweight material having a density in the range of, for example, 0.005 to 0.1 g/cm$^3$. By varying the number and/or orientation of the conductive fiber(s) that are included inside the small blocks, the dielectric constant of the material can be varied from, for example, about 1 to about 3.

In other embodiments, a spherical RF lens 130 may be a shell filled with a composite dielectric material that comprises a mixture of a high dielectric constant material and a light weight low dielectric constant base dielectric material. For example, the composite dielectric material may comprise a large block of foamed base dielectric material that includes particles (e.g., a powder) of a high dielectric constant material embedded therein. The lightweight, low dielectric constant base dielectric material may comprise, for example, a foamed plastic material such as polyethylene, polystyrene, polytetrafluoroethylene (PTEF), polypropylene, polyurethane silicon or the like that has a plurality of particles of a high dielectric constant material embedded therein. In some embodiments, the foamed lightweight low dielectric constant base dielectric material may have a foaming percentage of at least 50%.

The high dielectric constant material may comprise, for example, small particles of a non-conductive material such as, for example, a ceramic (e.g., $Mg_2TiO_4$, $MgTiO_3$, $CaTiO_3$, $BaTi_4O_9$, boron nitride or the like) or a non-conductive (or low conductivity) metal oxide (e.g., titanium oxide, aluminium oxide or the like). In some embodiments, the high dielectric constant material may have a dielectric constant of at least 10. The high dielectric constant material may comprise a powder of very fine particles in some embodiments. The particles of high dielectric constant material may be generally uniformly distributed throughout the base dielectric material and may be randomly oriented within the base dielectric material. In other embodiments, the composite dielectric material may comprise a plurality of small blocks of a base dielectric material, where each block has particles of a high dielectric constant dielectric material embedded therein and/or thereon. In some embodiments, the small blocks may be adhered together using, for example, an adhesive such as rubber adhesives or adhesives consisting of polyurethane, epoxy or the like, which are relatively lightweight and which exhibit low dielectric losses.

In some embodiments, the spherical RF lenses 130 may comprise blocks or other small particles of a dielectric material (e.g., the blocks described above) that are contained within an outer shell that has a desired shape for the RF lens (e.g., spherical shaped for the antenna 100 of FIG. 1). In such embodiments, an adhesive may or may not be used to adhere the blocks together. Base station antennas may be subject to vibration or other movement as a result of wind, rain, earthquakes and other environmental factors. Such movement can cause settling of the above-described blocks of dielectric material, particularly if an adhesive is not used. In some embodiments, the shell may include a plurality of individual compartments and the blocks may be filled into these individual compartments to reduce the effects of settling. The use of such compartments may increase the long term physical stability and performance of a lens. It will also be appreciated that the blocks may also and/or alternatively be stabilized with slight compression and/or a backfill material. Different techniques may be applied to different compartments, or all compartments may be stabilized using the same technique.

In still other embodiments, the dielectric material used to form the RF lens may be any of the dielectric materials disclosed in U.S. Provisional Patent Application Ser. No. 62/313,406, filed Mar. 25, 2016 ("the '406 application"), the entire contents of which are incorporated herein by reference. In particular, as disclosed in the '406 application, in some embodiments the dielectric material used to form the RF lens may comprise expandable microspheres (or other shaped expandable materials) that are mixed with a binder/adhesive (e.g., an oil binder) along with pieces of conductive materials (e.g., conductive sheet material) that are encapsulated in insulating materials. In some embodiments, the conductive materials may comprise glitter or flitter. Flitter may be formed, for example, by providing a thin sheet of metal (e.g., 6-50 microns thick) that has a thin insulative coating (e.g., 0.5-15 microns) on one or both sides thereof. This sheet material is then cut into small pieces (e.g., small 200-800 micron squares or other shapes having a similar major surface area). The expandable microspheres may comprise very small (e.g., 1-10 microns in diameter) spheres in some embodiments that expand in response to a catalyst (e.g., heat) to larger (e.g., 12-100 micron diameter) air-filled spheres. These expanded microspheres may have very small wall thickness and hence may be very lightweight. The expanded microspheres along with the binder may form a matrix that holds the conductive materials in place to form the composite dielectric material. Other foamed particles may also be added to the mixture such as foamed microspheres which may be larger than the expanded microspheres in some embodiments. In some embodiments, the expanded spheres may be significantly smaller than the conductive materials (e.g., small squares of glitter or flitter). For example, an average surface area of the small pieces of conductive sheet material having an insulating material on each major surface may exceed an average surface area of the expandable microspheres after expansion.

In another example embodiment disclosed in the '406 application, the dielectric material used to form the RF lens may be formed by adhering a thin conductive sheet (e.g., 5-40 microns thick) such as an aluminium foil between two thicker sheets of foamed material (e.g., 500-1500 micron thick sheets of foamed material). This composite foam/foil sheet material is into small blocks that are used to form a lens for an antenna. The foam sheets may comprise a highly foamed, lightweight, low dielectric constant material. One or more sheets of such foam may be used, along with one or more sheets of metal foil. The blocks of material formed in this manner may be held together using a low dielectric loss binder or adhesive or may simply be filled into a container to form the lens. In still other embodiments, Luneburg lenses may be used.

Each spherical RF lens 130 is used to focus the coverage pattern or "beam" emitted by its associated radiating element 120 in both the azimuth and elevation directions. In one example embodiment, the array of spherical RF lens 130 may shrink the 3 dB beamwidth of the composite beam output by the single-column phased array antenna 100 from about 65° to about 23° in the azimuth plane. By narrowing the half power beam width of the single-column phased array antenna 100, the gain of the antenna 110 may be increased by, for example, about 4-5 dB in example embodiments.

As discussed above, the RF lenses 130 may be mounted so that they are generally aligned along a first vertical axis V1, and the radiating elements 120 may be mounted so that they are generally aligned along a second vertical axis V2. As shown in FIG. 1, a center of each radiating element 120 is positioned vertically along the second vertical axis V2 at a point that is higher than a center of its associated spherical RF lens 130 is positioned along the first vertical axis V1. Each radiating element 120 may be positioned with respect to its associated spherical RF lens 130 so that a center of a radiation pattern that is emitted by the radiating element 120, when excited, is directed at a center point of its associated spherical RF lens 130. Each radiating element 120 may be positioned at the same distance from its associated spherical RF lens 130 as are the other radiating elements 120 with respect to their associated spherical RF lenses 130.

In some embodiments, each radiating element 120 may be individually angled with respect to the second vertical axis. As discussed above, each radiating element 120 will typically include a radiator 122 (e.g., one or more dipoles), feed stalks 124 and a ground plane 126. The feed stalks 124 are used to mount the radiator 122 at a desired distance in front of the ground plane 126 (e.g., a distance corresponding to one quarter of the wavelength of the signals that are to be transmitted through the antenna 100). In a conventional phased array antenna, the ground plane is typically planar and the feed stalks extend from the ground plane at a 90 degree angle. In most conventional base station phased array antennas, the radiating elements are arranged so that the ground planes are vertically-oriented and the feed stalks extend horizontally from the ground planes (which may be a plurality of individual ground planes or a single common ground plane).

As shown in FIG. 1, in the single-column phased array antenna 100, each radiating element 120 may be mechanically angled downwardly or "downtilted" with respect to the second vertical axis V2. For example, each radiating element 120 may be mechanically angled downward from the horizontal by an angle $\alpha$. In an example embodiment, a may be about 5 degrees, although other angles may be used. It will be appreciated that for a typical radiating element such as the radiating element 120 illustrated in FIGS. 6A and 6B, the electromagnetic radiation is primarily emitted in a direction perpendicular to the plane defined by the dipoles 122 (and/or the plane defined by the ground plane 126). If the radiating element 120 of FIGS. 6A and 6B is mounted in the antenna 100 of FIG. 1 with no downtilt, then the planes defined by the dipoles 122 and the ground plane 126 would be vertically oriented. When the above-described downtilt of, for example, 5° is applied, the planes defined by the dipoles 122 and the ground plane 126 would be tilted from a vertical axis by 5°. Such a mechanical downtilt is not achievable with a cylindrical RF lens configuration. Additionally, each radiating element 120 may be arranged orbitally with respect to its associated spherical RF lens 130. Herein, a radiating element 120 is arranged "orbitally" with respect to a spherical RF lens 130 when the radiating element 120 is pointed toward the center of the spherical RF lens 130. As shown in FIG. 1, the orbital arrangement may be achieved by positioning the spherical RF lenses 130 that is associated with a particular radiating element 120 in front of the radiating element 120 and lower than the radiating element 120 so that the beam emitted by the radiating element 120 is directed at the center of its associated spherical RF lens 130.

In the example embodiment of FIG. 1 where each radiating element is downtilted by an angle $\alpha$=5°, if the elevation beamforming network provides +/−5 degrees of electrical downtilt adjustment through the use of phase shifters that apply a linear phase shift to the RF signal fed to groups of radiating elements 120, the single-column phased array antenna 100 as a whole would have an electrical downtilt range from 0 to 10 degrees in light of the 5 degree mechanical downtilt on each radiating element 120. With a conventional linear array antenna where the radiating elements 120 are not mechanically downtilted, the overall beam pattern will have better characteristics (i.e., higher gain, reduced grating lobes, etc.) at a downtilt of 0 degrees as compared to a downtilt of 10 degrees (where the patterns are degraded) since the radiating elements 120 are all aimed at the horizon. If each radiating element 120 is downtilted 5 degrees mechanically, as described above, the elevation patterns will be offset by no more than 5 degrees when using an electrical downtilt to provide an overall downtilt of between 0 and 10 degrees. The performance of a linear array may degrade as the beam is electrically scanned, as is done when a linear array is electrically downtilted, in terms of maximum gain, beam symmetry and the suppression of grating lobes. Accordingly, the antenna 100 may provide improved performance as compared to a conventional antenna as it need not be electrically tilted more than 5 degrees where the conventional antenna must be tilted a full 10 degrees in order to achieve the 10 degree electrical downtilt. Each radiating element 120 may be mechanically downtilted the same amount. The amount of the mechanical downtilt (e.g., 5 degrees) refers to the amount that the radiating element is angled downwardly from a plane that is perpendicular to the plane defined by the horizon (angle $\alpha$ in FIG. 1). Typically, the ground plane 126 of each radiating element 120 will be tilted along with the remainder of the radiating element 120 when a mechanical downtilt is implemented. Accordingly, with reference to FIGS. 1 and 6A-6B, the ground plane 126 of each radiating element 120 will be tilted with respect to the mounting structure 110, as the mounting structure 110 is typically mounted in a vertical orientation. Thus, the ground planes 126 together with the mounting structure 110 may have a sawtoothed configuration in some embodiments.

While not shown in FIG. 1 to simplify the drawing, it will be appreciated that the antenna 100 may include a variety of other conventional elements (not shown) such as a radome, end caps, phase shifters, a tray, input/output ports and the like. The same is true with respect to the other example embodiments of the present invention discussed below.

Several advantages may be realized in an antenna comprising an array of radiating elements and individual spherical RF lenses associated with each radiating element. For example, as discussed above, narrowed half power beamwidths may be achieved in both the azimuth and elevation directions with fewer radiating elements. For example, a single column of five radiating elements and associated spherical RF lenses may produce an azimuth HPBW of 30-40 degrees and an elevation HPBW of less than 10 degrees in some embodiments. Thus, the antenna may benefit from reduced cost, complexity and size. Also, less dielectric material is required to form a linear array of spherical RF lenses 130 as compared to a single cylindrical lens that is shared by all of the radiating elements 120. The lens volume=$(4/3)*\pi*r^3$ for each spherical RF lens 130, where "r" is the radius of the sphere. For example, for an antenna that includes four radiating elements and spherical lenses that has a length L=8r, the total volume of the spherical RF lenses would be $(16/3)*\pi*r^3$, while the volume of an equivalent cylindrical lens would be $8*\pi*r^3$, or 1.33 times more. The spherical RF lenses 130 also provide an additional benefit of improved cross polarization performance.

In the above example, each spherical RF lens 130 and its associated radiating element 120 may replace a sub-array of multiple radiating elements of a comparable conventional linear phased array antenna. The antenna 100 may be used, for example, as a base station antenna having desired azimuth and elevation HPBW.

Figure 2:
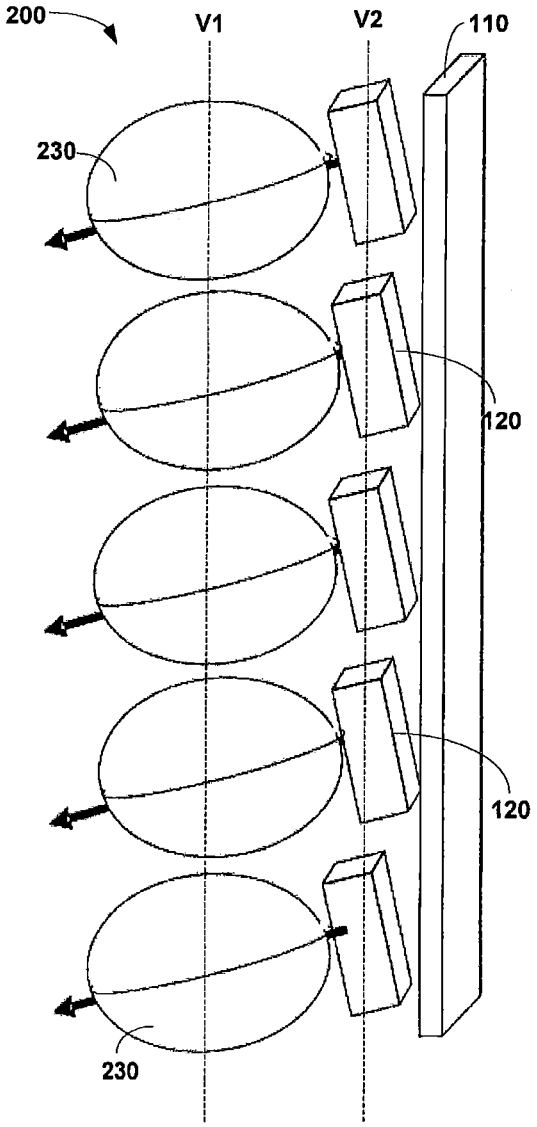
FIG. 2 is a schematic side view of a single-column phased array antenna that includes an elliptical RF lens for each radiating element.

FIG. 2 is a schematic side view of a single-column phased array antenna 200 that includes an elliptical RF lens for each radiating element thereof. As can be seen by comparing FIGS. 1 and 2, the single-column phased array antenna 200 may be identical to the single-column phased array antenna 100 except that the spherical RF lenses 130 included in the antenna 100 are replaced in the antenna 200 with elliptical RF lenses 230. As the remaining components of antennas 100 and 200 may be the same, FIGS. 1 and 2 otherwise use like numbering for the elements thereof and repeated descriptions thereof will be omitted for brevity.

The elliptical RF lenses 230, like the spherical RF lenses 130, shape the beamwidths of the radiation patterns emitted by the respective radiating elements 120 in both the azimuth and elevation directions. The elliptical RF lenses 230 may be somewhat larger than the spherical RF lenses 130, but may still have less (or similar) volume as compared to a conventional cylindrical RF lens design. The elliptical RF lenses 230 otherwise have advantages similar to the spherical RF lenses 130, including improved cross polarization performance and the capability for each radiating element 120 to be mechanically downtilted while remaining in an orbital relationship with respect to its associated elliptical RF lens 230 in the manner described above. Additionally, the elliptical RF lenses 230 allow for further flexibility in obtaining the desired elevation half power beamwidth with differing numbers of RF lenses. This can help in terms of optimizing the corporate feed network that supplies RF signals to and from the radiating elements 120. Moreover, the elliptical shape of the lenses 230 may allow for better control of sidelobes in the radiation beam in the azimuth direction.

As shown in FIG. 2, in some embodiments, each elliptical RF lens 230 may be positioned so that the radiation beam emitted by its associated radiating element 120 travels along the major axis of the elliptical lens 230 through the center of the elliptical lens 230. Thus, when elliptical lenses 230 are used, it may be desirable to tilt each elliptical lens 230 the same amount that its corresponding radiating element 120 is tilted.

The use of elliptical RF lenses such as the lenses 230 may be particularly advantageous in applications where the difference between the required azimuth and elevation beamwidths is particularly pronounced. As noted above, when spherical RF lenses 130 are used, the number and layout of the radiating elements 120 in a single-column linear phased array may be used to control the elevation beamwidth while the size of each spherical RF lenses 130 and the distance of each spherical RF lens 130 from its associated radiating element 120 may be used, among other things, to control the azimuth beamwidth. When elliptical RF lenses 230 are used instead of the spherical RF lenses 130, the ratio of the major and minor axes of the elliptical RF lens 230 may be adjusted to achieve a desired combination of azimuth and elevation beamwidths. This may allow each radiating element 120 to be located at a desired distance from its corresponding RF lens and may also allow a reduction in the total number of radiating elements included in the array since elliptical RF lens 230 may be selected that narrow the elevation beam more than the azimuth beam. This may be achieved by using elliptical RF lenses 230 that have a major axis extending in the horizontal direction and a minor axis extending in the vertical direction. Of course, if the radiating elements 120 are mechanically downtilted a small amount (e.g., 5°) in the manner described above in order to provide improved remote electronic tilt performance then the major axis of each elliptical lens 230 will also be offset (i.e., downtilted) from the horizontal plane by the same amount.

Figure 10:
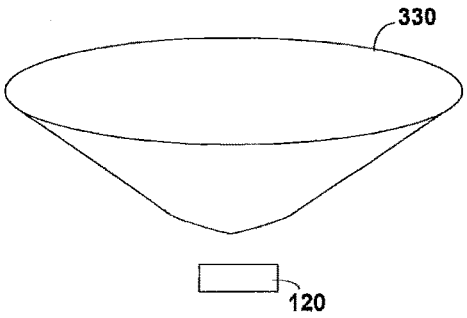
FIG. 10 is a schematic perspective view of a hyperboloid shaped RF lens that may be used in antennas according to further embodiments of the present invention.

While FIG. 2 illustrates an embodiment of the present invention in which the spherical RF lens 130 of antenna 100 are replaced with elliptical RF lenses 230, it will be appreciated that embodiments of the present invention are not limited to these two shapes for the RF lenses. In particular, in further embodiments of the present invention, different shaped RF lenses may be used such as, for example, hyperboloid shaped RF lenses such as the lens 330 shown in FIG. 10. The hyperboloid shaped RF lenses 330 may be filled with, for example, any of the dielectric materials that are discussed above. The location of a radiating element 120 with respect to its associated hyperboloid lens 330 is also schematically depicted in FIG. 10.

Figure 3:
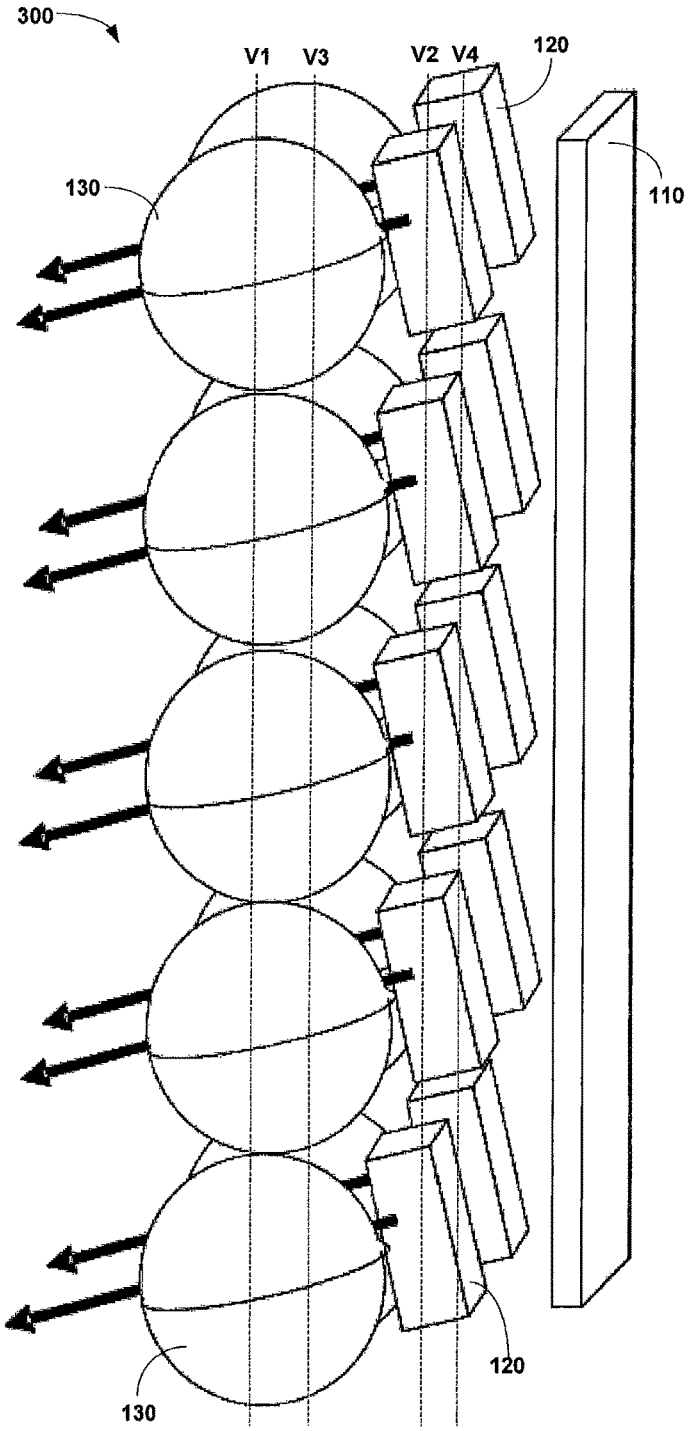
FIG. 3 is a schematic perspective view of a multi-column phased array antenna that has multiple columns of radiating elements and that includes a spherical RF lens for each radiating element.

It will also be appreciated that the above-described concepts may be extended to antennas that include multiple columns of radiating elements. For example, as shown in FIG. 3, according to further embodiments of the present invention, multi-column phased array antennas may be provided that include two (or more) columns of radiating elements 120 with each radiating element having an associated RF lens 130. In particular, as shown in FIG. 3, a multi-column phased array antenna 300 according to embodiments of the present invention includes two vertically disposed columns of five radiating elements 120 each that are mounted side-by-side on a mounting structure 110. An RF lens 130 is associated with each radiating element 120 thereof. In the depicted embodiment, each RF lens 130 comprises a spherical RF lens 130, but it will be appreciated that other lens shapes may be used in other embodiments (e.g., the elliptical lenses 230 shown in FIG. 2 could be used instead). As can be seen by comparing FIGS. 1 and 3, the multi-column phased array antenna 300 may be identical to the single-column phased array antenna 100 except that the multi-column phased array antenna 300 includes a second column of associated spherical RF lenses 130 that are aligned along a third vertical axis V3 and a second column of radiating elements 120 that are aligned along a fourth vertical axis V4. Thus, the description below will focus on this difference between the two antennas 100 and 300.

In the antenna 300, the two columns of radiating elements 120 may be fed by a corporate feed network (not shown). The antenna 300 may be designed so that the radiating elements 120 and associated lenses 130 create a single beam such as, for example, a beam that is designed to cover a sector of a cellular base station. In such embodiments, the additional column of radiating elements 120 may further narrow the resulting beam in the azimuth direction. Alternatively, the two columns of radiating elements 120 may be fed with two sources and a Butler matrix beamforming network to generate a pair of beams, with each beam being electrically steered off of mechanical boresight for the antenna 300. As noted above, the spherical RF lenses 130 may be replaced with elliptical RF lenses 230 or with other shaped RF lenses. The RF lenses 130, 230 may be used to shape the beam pattern of each radiating element 120 in both the azimuth and elevation directions, and therefore affect the overall beam pattern in the azimuth and elevation directions. The advantages noted above with respect to grating lobes apply in this example to both the spacing between the two columns of radiating elements 120 and to the spacing of radiating elements 120 within each column. For example, the two columns of radiating elements 120 may be spaced further apart (i.e., greater horizontal separation between radiating elements 120) to narrow the azimuth beamwidth, and the beam pattern of each radiating element 120, modified by its associated spherical RF lens 130, may suppress any sidelobes or grating lobes at high angles in the array factor.

It will also be appreciated that, while the example antenna 300 of FIG. 3 includes two columns of five radiating elements 120 each, the number of columns of radiating elements 120 and the number of radiating elements 120 included in each column may be varied as appropriate.

Figure 4A:
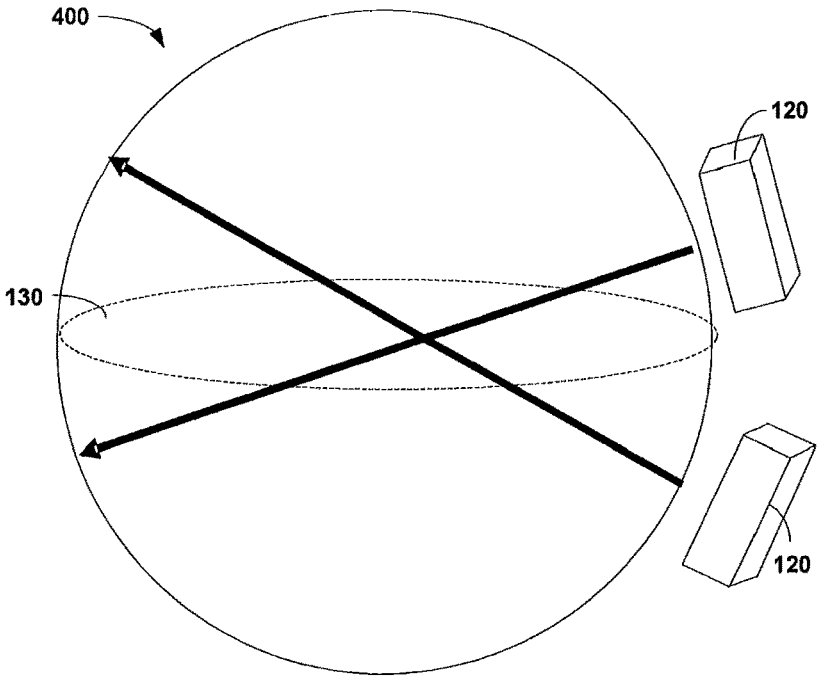
FIG. 4A is a schematic top view of a multi-beam single-column phased array antenna that includes two radiating elements for each of a plurality of spherical RF lens.
Figure 4B:
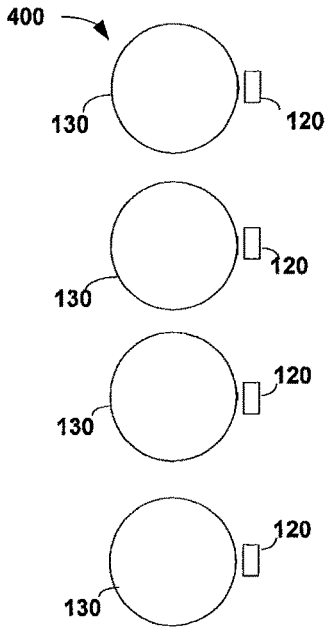
FIG. 4B is a schematic side view of the multi-beam single-column phased array antenna of FIG. 4A.
Figure 5:
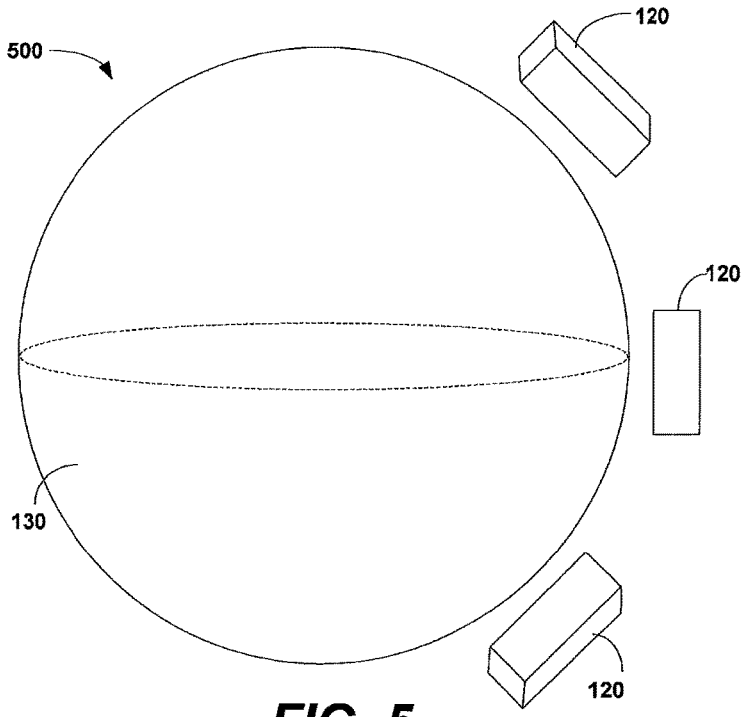
FIG. 5 is a schematic top view of a multi-beam single-column phased array antenna that includes three radiating elements for each of a plurality of spherical RF lens.

It will also be appreciated that according to still further embodiments of the present invention, multi-column phased array antennas may be provided that include two or more vertical columns of radiating elements and at least one vertical column of RF lenses. In these antennas, each RF lens may be associated with two or more of the radiating elements that are offset in the azimuth (horizontal) direction. FIGS. 4A-4B and 5 illustrate example embodiments of such antennas.

For example, referring first to FIGS. 4A-4B, FIG. 4A is a schematic top view of a multi-beam single-column phased array antenna 400 that includes two radiating elements for each of a plurality of spherical RF lens. FIG. 4B is a schematic side view of the multi-beam single-column phased array antenna 400 of FIG. 4A. The multi-beam single-column phased array antenna 400 includes two columns of radiating elements 120 and a single column of spherical RF lenses 130. The spherical RF lenses 130 are positioned in front of, and midway between, the two columns of radiating elements 120. A total of ten radiating elements 120 are provided (5 per column) and a total of five spherical RF lenses 130 are provided. Each column of radiating elements 120 may include its own source. For example, the first column of radiating elements 120 may be fed by respective first and second corporate feed networks that are connected to respective first and second radios that supply RF signals at each of the two orthogonal polarizations to the radiating elements 120 in the first column, and the second column of radiating elements 120 may be fed by third and fourth corporate feed networks that are connected to third and fourth radios that supply RF signals at each of the two orthogonal polarizations to the radiating elements 120 in the second column. The antenna 400 may produce a set of two independent beams (with each beam supporting two polarizations) that are aimed at different azimuth angles, as shown by the bold arrows in FIG. 4A. As a result, the antenna 400 may be used to further sectorize a cellular base station. For example, the antenna 400 may be designed to generate two side-by-side beams that each have a half power azimuth beamwidth of about 33 degrees. Three such antennas 400 could be used to form a six-sector cell.

It will also be appreciated that in further embodiments more than two radiating elements 120 may share each spherical RF lens 130. For example, FIG. 5 is a schematic top view of a multi-beam single-column phased array antenna 500 that includes three radiating elements 120 for each of a plurality of spherical RF lens 130. The third column of radiating elements 120 may be fed by fifth and sixth corporate feed networks that are connected to fifth and sixth radios that supply RF signals at each of the two orthogonal polarizations to the radiating elements 120 in the third column. The antenna 500 may thus generate three independent beams. In an example embodiment, each of these beams may have a beamwidth of about 40° so that the antenna 500 may provide coverage to a 120° sector of a sectorized cellular base station using three independent beams to cover the sector. This exhibits the same functionality seen with multi-beam Butler matrix-fed antennas, but without the complexity, insertion loss and frequency bandwidth limitations of the Butler matrix. As the antenna 500 may otherwise be identical to the antenna 400, further description thereof will be omitted.

It will likewise be appreciated that the lenses 130 illustrated in FIGS. 4A-4B and 5 may be replaced with other shaped lenses such as elliptical lenses in further embodiments. Moreover, according to further embodiments of the present invention, the single-column phased array antennas 400 and 500 that are described above may be expanded into multi-column phased array antennas by adding one or more additional columns of radiating elements and associated RF lenses.

The beam patterns produced by the above-described single-column and multi-column phased array antennas according to embodiments of the present invention will, in each case, be the product of a radiating element factor and an array factor. As the spacing between adjacent radiating elements (e.g., radiating elements in the same column) is increased in an effort to narrow beamwidth while maintaining the same number of radiating elements or reducing the number of radiating elements, grating lobes may be introduced at high angles in the array factor, for example, at +/−85°. However, as the RF lenses modify the beam patterns of the individual radiating elements, the beam patterns of the radiating elements may be rolled off to effectively zero at +/−85°, thereby suppressing any grating lobes. This is true in both the elevation and azimuth patterns in multi-column arrays. This provides additional flexibility in designing the antenna. For example, the number of radiating elements required to fill a specific aperture size with an associated directivity and scanning performance can be reduced by increasing the spacing between radiating elements. For an active antenna this means the number of transceivers, which is typically one per radiating element, can also be reduced, resulting in significant cost, size and weight savings. For a multi-column active array, this proposed solution can lead to significant cost reduction: for example, a 10×10 array of radiating elements with a half wavelength spacing between radiating elements could become a 5×5 array of radiating elements with a wavelength spacing between radiating elements. In this example, the number of transceivers required (for an antenna with active radiating elements) would be reduced from 100 down to 25.

In each of the above-described embodiments, the radiating elements may be constructed at fixed mechanical offset angles from a typical boresight angle (e.g., at a fixed mechanical downtilt of between 2° and 10° with respect to the horizon), as is shown in the examples of FIGS. 1-3. It will be appreciated, however, that in other embodiments the radiating elements may be movable. For example, in embodiments in which spherical RF lens are used, each radiating element may be designed so that it may move orbitally about some portion of its associated spherical RF lens. In some embodiments, the radiating elements may be designed so that they may move in two dimensions during such orbital movement. For example, an antenna may be designed so that after installation it can be mechanically downtilted from a remote location by causing the radiating elements to move along the vertical axis (elevation direction) and along an axis perpendicular to both the vertical axis and the horizontal axis (azimuth direction) to effect the downtilt via orbital movement. In other embodiments, the radiating elements may be moved in all three dimensions, thereby allowing the antenna to scan off the original boresight in both the azimuth and elevation directions. Since the radiating element is physically moved orbitally about the spherical RF lens to perform the "scanning" of the beam, the problems associated with electronic scanning—namely reduced gain, asymmetric pattern formation and grating lobes—may be avoided.

As shown in FIGS. 1-3, each radiating element is positioned with respect to its associated RF lens in the same manner that the other radiating elements are positioned with respect to their associated RF lenses when, for example, the radiating elements are designed to effect a mechanical downtilt. However, in further embodiments, each combination of a radiating element and its associated lens may be moved or aimed independently of the other radiating element/lens combinations to effect the radiation properties of the antenna. In addition, and in tandem or independently, the orientation of the radiating element to the lens can be displaced, tilted or orbited to effect the radiation properties of the antenna. It should be noted that for both single-column and multi-column phased array antennas according to embodiments of the present invention, if each radiating element is mechanically orbited around its spherical lens to mechanically scan its beam, and the electrical beam scan created by the electrical phasing of the antenna elements is synchronized and identical, then there will no scanning gain loss as the beam is scanned.

It will be appreciated that if each radiating element can be independently mechanically orbited around its spherical RF lens to mechanically scan the beam, then this capability provides an additional degree of freedom in beam pattern shaping beyond the adjustment of the phase and amplitude of the signal provided to each radiating element. Because the diameter of the spherical RF lens is small in terms of the wavelength of the RF signal that is transmitted through the antenna (or received by the antenna), that is, the diameter of the spherical RF lens is typically between one and three wavelengths of the RF signal, a Luneburg lens in not necessary and an RF lens with a homogenous dielectric constant can be utilized. Also, as with the other embodiments discussed above, the shape of the RF lens does not necessarily need to be spherical and other shapes (e.g., elliptical) can be used to effect the radiation properties of the combination of each radiating element and its associated RF lens as well as the radiation properties of the array as a whole. Also, the dielectric constant of each RF lens in the array of RF lenses can be varied to effect the radiation properties of each combination of a radiating element and its associated RF lens and the radiation properties of the entire array. This capability provides an additional degree of freedom in beam pattern scanning and shaping beyond the adjustment of the phase and amplitude at each radiating element.

It will likewise be appreciated that the types of radiating elements used and the properties for individual RF lenses can be varied to effect the radiation properties of the combination of a radiating element and an associated RF lens and/or the radiation properties of the entire array. RF lenses can also be omitted with respect to some of the radiating elements in some embodiments.

Also in an array of RF lenses, the polarization properties of each lens can be varied to effect the polarization and radiation properties of the combination of a radiating element and an associated lens and the polarization and radiation properties of the entire array.

Pursuant to further embodiments of the present invention, planar arrays of lensed antennas may be used for massive multi-input-multi-output ("MIMO") antenna applications. MIMO refers to using multiple transmit and receive antennas for a radio link to increase capacity. Independent data streams are split out and transmitted through multiple antennas and the received signals are received through multiple antennas and then combined at a receiver. The multiple transmit antennas and/or the multiple receive antennas may be separate antennas or may comprise one (or more) multi-beam antennas that have individual beamforming capabilities.

The use of large planar array antenna such as 10×10 arrays that have 100 radiating elements or 16×16 arrays that have 256 radiating elements have been proposed for massive MIMO applications. Each radiating element would be an "active" element in that it would have its own radio. By using digitally introduced amplitude and/or phase weighting these antennas can be configured to generate a plurality of narrow beams that can be actively directed to locations where users are present. These antennas may provide for more efficient spectrum use since the narrow beams allow for frequency reuse within the beam area of the antenna and much higher antenna gain (reducing transmit power requirements).

Figure 7:
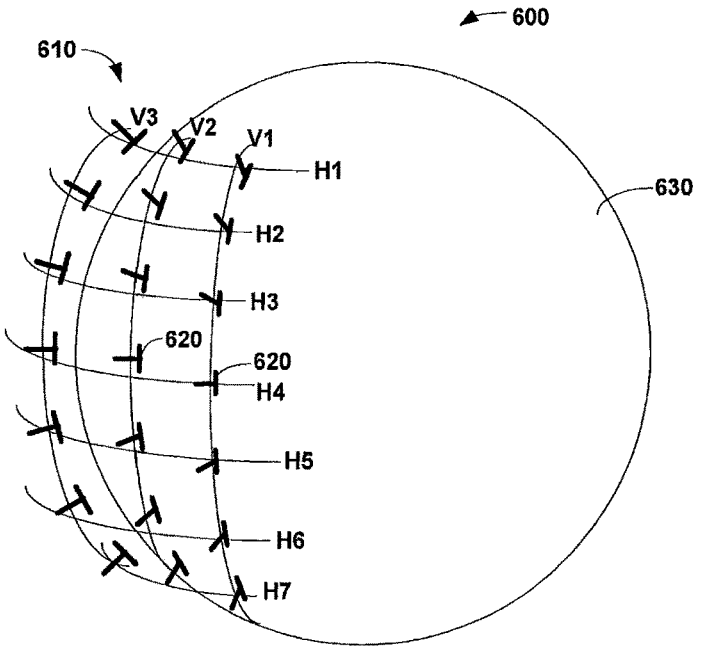
FIG. 7 is a schematic perspective view of a multi-beam antenna suitable for use in massive multi-input-multi-output ("MIMO") applications.

FIG. 7 is a schematic perspective view of a multi-beam antenna 600 according to embodiments of the present invention that may be suitable for massive MIMO and various other applications. As shown in FIG. 7, the antenna 600 comprises an array 610 of radiating elements 620. The array 610 may include multiple (i.e., at least two) rows and columns of radiating elements 620. In a typical example, the antenna 600 may include four to eight rows and four to eight columns of radiating elements 620, although other numbers of rows and/or columns may be used. In the depicted embodiment, five columns of radiating elements 620 are provided (only three of the columns are visible in FIG. 7; the fourth and fifth columns are at the same positions as the second and first columns, respectively, on the backside of the spherical RF lens 630), where each column includes seven radiating elements 620 for a total of thirty-five radiating elements 620. The number of rows need not be equal to the number of columns. Moreover, as will become clear from the discussion below and as can be seen in FIG. 7, these "rows" and "columns" may not refer to linear arrangements in some embodiments but instead may refer to arcs of radiating elements 620 due to the orbital placement of the radiating elements 620 with respect to an RF lens structure.

Still referring to FIG. 7, an RF lens 630 such as a spherical RF lens or an elliptical RF lens is positioned in front of the array 610 of radiating elements 620. In the embodiment of FIG. 7, each of the radiating elements 620 may comprise an active antenna element. As known to those of skill in the art, an active antenna element refers to a radiating element that is directly fed by a dedicated transceiver (radio). The use of active antenna elements 620 provides increased flexibility and capabilities as the signals that are to be transmitted through each radiating element 620 may be manipulated digitally prior to transmission. Thus, for example, the amplitude and/or phase of the signals transmitted through each active radiating element 620 may be set in advance for purposes of antenna beamforming.

As shown in FIG. 7, the RF lens 630 comprises a spherical RF lens. The spherical RF lens 630 may have the structure of any the RF lenses discussed above. For example, in some embodiments, the spherical RF lens 630 may be formed of a very lightweight artificial dielectric material that has a dielectric constant in the range of, for example, 1 to 3. The spherical RF lens 630 in this embodiment may be a larger structure and it may be shared by each of the thirty-five active radiating elements 620. Each of the active radiating elements 620 are arranged orbitally around one side of the spherical lens 630. Accordingly, each radiating element 620 may be positioned at the same distance from the spherical RF lens 630, and each radiating element 620 may be positioned so that a center of a radiation pattern that is emitted by the radiating element 620 when excited is substantially directed at a center point of the spherical RF lens 630. As noted above, the active radiating elements 620 may be arranged in what may loosely be termed as "columns" and "rows," although it will be appreciated that the active radiating elements 620 in reality will be arranged in rows and columns of arcs due to their orbital placement about the spherical RF lens 630.

As can be seen in FIG. 7, each row of radiating elements 620 extends in a respective arc in a respective one of a plurality of horizontal planes HP1-HP7 and each column of radiating elements 620 extends in a respective arc in a respective one of a plurality of vertical planes VP1-VP3 (note that the radiating elements that are not visible in FIG. 7 extend in two arcs in two additional vertical planes VP4-VP5, which are not visible in the drawing). The horizontal planes HP1-HP7 are substantially parallel to each other and hence do not intersect each other. In some embodiments, the vertical planes VP1-VP5 may extend along longitudinal cuts through the sphere that are akin to the longitudinal lines on a globe. In such embodiments, the radiating elements 620 in a "row" have decreased separation between each other for "rows" that are farther removed from the equator. In other embodiments, the same horizontal separation may be maintained between adjacent radiating elements 620 in a "row" for the radiating elements 620 in all of the horizontal planes HP1-HP7. This arrangement may provide more uniform coverage by the pencil beams. In each case, the radiating elements 620 may be arranged orbitally in that each radiation may be located at the same distance from the spherical lens 630 and point towards the center of the spherical lens 630.

Figure 8:
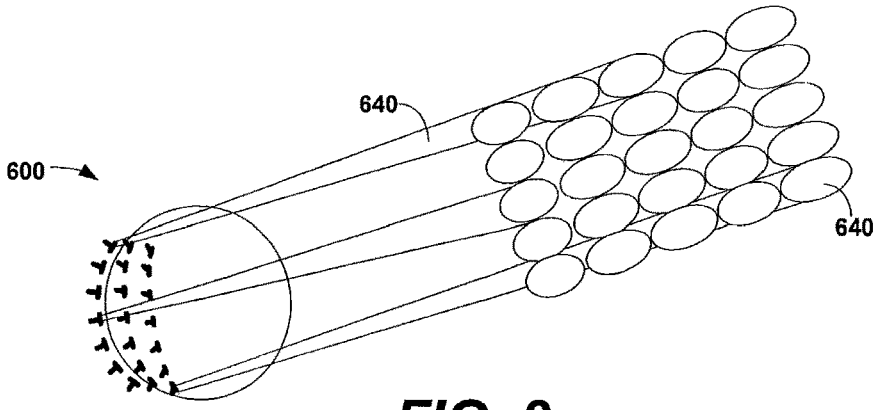
FIG. 8 is a schematic view of beams that may be formed by the multi-beam antenna of FIG. 7.

In the embodiment of FIG. 7, each active radiating element 620 may be used to form a beam that covers a portion of the coverage area served by the antenna 600. As the spherical RF lens 630 narrows these beams in both the azimuth and elevation directions, a plurality of so-called "pencil beams" may be formed by the antenna 600 that together cover the full sector that is served by the antenna 600. FIG. 8 is a schematic drawing that is an example rendering of the beams 640 that can be formed by the multi-beam antenna 600 in greater detail. As shown in FIG. 8, each active radiating element 620 forms a narrow beam 640. The active antenna elements 620 may amplitude and phase weight the transmitted signals so that each beam 640 may have a small amount of downtilt with respect to the horizon. Because of this downtilt, each beam 640 may be directed towards the ground at a certain distance from the antenna 600. Such a design may ensure that the antenna 600 does not interfere with other nearby antennas that operate in the same frequency band that provide coverage to adjacent areas (e.g., adjacent cells of a cellular communications system). As shown in FIG. 8, because of this design, the plurality of beams 640 may together form something akin to a checkerboard pattern throughout the coverage area for antenna 600, with each beam 640 providing coverage to a different portion of the coverage area, as is shown schematically in FIG. 8. Each beam 640 may be used to transmit signals to, and receive signals from, fixed or mobile users that are located within the portion of the coverage area that is covered by the beam 640. For example, if three users are within the portion of the coverage area served by a particular beam 640, then the available bandwidth may be split between those three users. If only one user is present at a particular point in time within the coverage area of another beam 640, then the entire available bandwidth may be dedicated to that user, providing a higher quality signal. It will be appreciated that the radiating elements 620 are depicted schematically in FIG. 8 and can be implemented as either single polarization or dual polarization radiating elements, and that any appropriate type of radiating element (e.g., dipole, cross-dipole, patch, horn, etc.) may be used.

Figure 9:
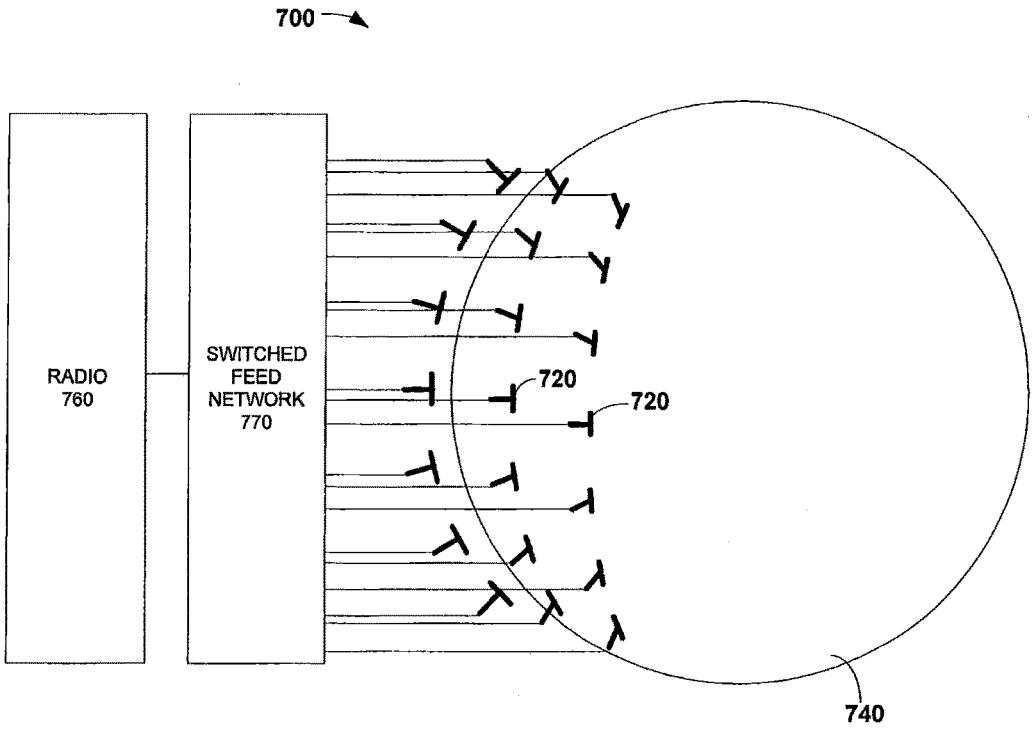
FIG. 9 is a schematic perspective view of a multi-beam antenna suitable for use in massive multi-input-multi-output ("MIMO") applications.

FIG. 9 is a schematic view of another multi-beam antenna 700 according to further embodiments of the present invention that may likewise be suitable for massive MIMO and various other applications. The antenna 700 may be similar to the antenna 600, except that the antenna 700 includes standard (i.e., non-active) radiating elements 720 instead of the active radiating elements 620 included in the antenna 600. The radiating elements 720 may form a plurality of pencil beams that together provide coverage to a coverage area of the antenna 700. A radio 760 may be connected to the radiating elements 720 via, for example, a network of high speed RF switches 770. The switch network 770 may be used to selectively supply a signal from the radio 760 to one or more of the radiating elements 720 during the time slots of a frequency and time division multiplexing communication scheme. The switch network 770 may be switched at high speeds so as to direct the signal to be transmitted during any particular time slot to the radiating element(s) 720 that provide coverage to portions of the coverage area that include users who transmit/receive signals during that particular time slot. During the next time slot, the switch network 770 may be reconfigured to selectively supply the signal from the radio 760 to a different subset of the radiating elements 720 that provide coverage to portions of the coverage area that include users who transmit/receive signals during this subsequent time slot.

The multi-beam antennas 600 and/or 700 may have a number of advantages as compared to a conventional planar array phased array antenna. The large spherical RF lenses 630, 730 will narrow the beams of the radiating elements 620, 720 in both the azimuth and elevation directions. As a result, the arrays 610, 710 may have a substantially smaller number of radiating element 620, 720 as compared to the number of radiating elements required if the lenses 630, 730 are not used. Additionally, because the radiating elements 620, 720 are arranged around much of a side of the spherical RF lens 630, 730, the antennas 600, 700 are able to form beams at fairly large angles off of the boresight angle in the azimuth direction without experiencing the above-described problems that arise when conventional antennas are scanned off boresight in this manner such as reduced gain, nonsymmetrical antenna patterns and the generation of grating lobes, as the orbital arrangement of the radiating elements 620, 720 means that many of the radiating elements will be directed off "boresight" for the antennas 600, 700. Thus, it is expected that the antennas 600, 700 may be less expensive than comparable planar array antennas while providing improved performance when used in applications such as massive MIMO applications.

It will be appreciated that numerous modifications may be made to the multi-beam antennas 600 and/or 700 without departing from the scope of the present invention. For example, while the antennas 600, 700 each use a spherical RF lens 630, 730, it will be understood that elliptical RF lens could be used instead in other embodiments. It will also be appreciated that other RF lens shaped could be used. It will likewise be appreciated that the numbers of radiating elements may be varied from what is shown, as may the numbers of "rows" and/or "columns." Additionally, in still other embodiments that use passive radiating elements, a corporate feed network may be used where each output of the corporate feed network is coupled to a sub-array radiating elements. For example, each output of the corporate feed network could be coupled to two, three or four radiating elements and provide the same signal to each of these radiating elements. A similar approach may be used on embodiments that use active radiating elements by combining the signals fed to a sub-array of elements in the digital domain.

While the description above has primarily focused on using RF lenses with base station antennas in cellular communications systems, it will readily be appreciated that the RF lens arrangements disclosed herein may be used in a wide variety of other antenna applications, specifically including any antenna applications that use a phased array antenna, a multi-beam antenna or a reflector antenna such as parabolic dish antennas. By way of example, backhaul communications systems for both cellular networks and the traditional public service telephone network use point-to-point microwave antennas to carry high volumes of backhaul traffic. These point-to-point systems typically use relatively large parabolic dish antennas (e.g., parabolic dishes having diameters in the range of, perhaps, one to six feet), and may communicate with similar antennas over links of less than a mile to tens of miles in length. By providing more focused antenna beams, the sizes of the parabolic dishes may be reduced, with attendant decreases in cost and antenna tower loading, and/or the gain of the antennas may be increased, thereby increasing link throughput. Thus, it will be appreciated that embodiments of the present invention extend well beyond base station antennas and that the RF lenses disclosed herein can be used with any suitable antenna.

Embodiments of the present invention have been described above with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present invention. As used herein, the term "and/or" includes any and all combinations of one or more of the associated listed items.

It will be understood that when an element is referred to as being "on" another element, it can be directly on the other element or intervening elements may also be present. In contrast, when an element is referred to as being "directly on" another element, there are no intervening elements present. It will also be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (i.e., "between" versus "directly between", "adjacent" versus "directly adjacent", etc.).

Relative terms such as "below" or "above" or "upper" or "lower" or "horizontal" or "vertical" may be used herein to describe a relationship of one element, layer or region to another element, layer or region as illustrated in the figures. It will be understood that these terms are intended to encompass different orientations of the device in addition to the orientation depicted in the figures.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" "comprising," "includes" and/or "including" when used herein, specify the presence of stated features, integers, steps, operations, elements, and/or components, but do not preclude the presence or addition of one or more other features, integers, steps, operations, elements, components, and/or groups thereof.

In the detailed description above, numerous specific details are set forth to provide a thorough understanding of embodiments of the present disclosure. However, it will be understood by those skilled in the art that the present invention may be practiced without these specific details. In some instances, well-known methods, procedures, components and elements have not been described in detail so as not to obscure the present disclosure. It is intended that all embodiments disclosed herein can be implemented separately or combined in any way and/or combination. Aspects described with respect to one embodiment may be incorporated in different embodiments although not specifically described relative thereto. That is, all embodiments and/or features of any embodiments can be combined in any way and/or combination.

That which is claimed is:

1. A phased array antenna, comprising:

a plurality of radiating elements; and a plurality of radio frequency ("RF") lenses that are generally aligned along a first vertical axis, wherein each radiating element is associated with a respective one of the RF lenses, wherein each radiating element is tilted with respect to the first vertical axis, and wherein each radiating element is mounted to extend forwardly from a respective ground plane, and wherein each ground plane is vertically aligned along a third vertical axis, and wherein each ground plane defines a respective plane that is tilted at least 2 degrees with respect to the third vertical axis.

2. The phased array antenna of claim 1, wherein the radiating elements are aligned along a second vertical axis that is parallel to the first vertical axis.

3. The phased array antenna of claim 1, wherein a center of each radiating element is positioned vertically along the second vertical axis at a point that is higher than a center of its associated RF lens along the first vertical axis when the phased array antenna is mounted for use.

4. The phased array antenna of claim 1, wherein each radiating element is positioned so that a center of a radiation pattern that is emitted by the radiating element when excited is directed at a center point of its associated RF lens.

5. The phased array antenna of claim 1, wherein each radiating element is tilted between 2 and 10 degrees with respect to the first vertical axis.

6. The phased array antenna of claim 5, wherein each radiating element is tilted the same amount with respect to the first vertical axis.

7. The phased array antenna of claim 1, wherein each RF lens comprises a spherical RF lens.

8. A phased array antenna, comprising:

a plurality of radiating elements; and a plurality of radio frequency ("RF") lenses that are generally aligned along a first vertical axis, wherein each radiating element is associated with a respective one of the RF lenses, wherein each radiating element is tilted with respect to the first vertical axis, and wherein each RF lens comprises an elliptical RF lens.

9. The phased array antenna of claim 1, wherein each radiating element is positioned at the same distance from its associated RF lens.

10. The phased array antenna of claim 1, wherein the RF lens includes a dielectric material that comprises a foamed base dielectric material having conductive fibers embedded therein.

11. A phased array antenna, comprising:

a plurality of radiating elements; and a plurality of radio frequency ("RF") lenses that are generally aligned along a first vertical axis, wherein each radiating element is associated with a respective one of the RF lenses, wherein each radiating element is tilted with respect to the first vertical axis, and wherein the plurality of radiating elements comprise a first plurality of radiating elements and the plurality of RF lenses comprise a first plurality of RF lenses, the phased array antenna further comprising a second plurality of RF lenses aligned along a third vertical axis and a second plurality of radiating elements aligned along a fourth vertical axis.

12. The phased array antenna of claim 1, wherein the plurality of radiating elements comprise a first plurality of radiating elements, the phased array antenna further comprising a second plurality of radiating elements aligned along a fourth vertical axis, wherein each second radiating element is associated with a respective one of the RF lenses.

13. The phased array antenna of claim 12, wherein the first plurality of radiating elements are configured to form a first sector beam and the second plurality of radiating elements are configured to form a second sector beam.

14. The phased array antenna of claim 12, wherein a center of each radiating element in the first plurality of radiating elements is positioned vertically along the second vertical axis at a point that is higher than a center of its associated RF lens along the first vertical axis, and wherein a center of each radiating element in the second plurality of radiating elements is positioned vertically along the fourth vertical axis at a point that is higher than a center of its associated RF lens along the first vertical axis.

15. A multi-beam antenna, comprising:

a plurality of radiating elements; and a radio frequency ("RF") lens that is positioned in front of the radiating elements, wherein the radiating elements are positioned at least part of the way around a side of the RF lens, and wherein the radiating elements are arranged in a plurality of rows and columns, where each row extends in a respective arc in a respective one of a plurality of horizontal planes and each column extends in a respective arc in a respective one of a plurality of vertical planes.

16. The multi-beam antenna of claim 15, wherein the RF lens comprises a spherical RF lens, and wherein the radiating elements are orbitally arranged part of the way around the side of the spherical RF lens.

17. The multi-beam antenna of claim 15, wherein the plurality of horizontal planes comprise a plurality of substantially parallel planes, and wherein the plurality of vertical planes comprise a plurality of substantially parallel planes.

18. The multi-beam antenna of claim 15, wherein the plurality of horizontal planes comprise a plurality of substantially parallel planes, and wherein the plurality of vertical planes intersect each other.

19. The multi-beam antenna of claim 16, wherein each radiating element is mounted on a respective ground plane, and wherein each ground plane is orbitally arranged with respect to the spherical RF lens.

20. The phased array antenna of claim 1, wherein the respective planes defined by the respective ground planes each extend in parallel to a plane defined by the dipole arms of a respective one of the radiating elements.

21. The phased array antenna of claim 8, wherein each radiating element is positioned to emit a radiation beam that travels along a major axis of its associated RF lens.

* * * * *